US009269338B2

(12) United States Patent
Stern et al.

(10) Patent No.: US 9,269,338 B2
(45) Date of Patent: Feb. 23, 2016

(54) MUSICAL INSTRUMENT ACCESSORY

(71) Applicants: Albert I. Stern, Malibu, CA (US); Shawn B. Stern, Malibu, CA (US)

(72) Inventors: Albert I. Stern, Malibu, CA (US); Shawn B. Stern, Malibu, CA (US)

( * ) Notice: Subject to any disclaimer, the term of this patent is extended or adjusted under 35 U.S.C. 154(b) by 0 days.

(21) Appl. No.: 14/270,150

(22) Filed: May 5, 2014

(65) Prior Publication Data

US 2015/0187345 A1 Jul. 2, 2015

Related U.S. Application Data

(63) Continuation-in-part of application No. 14/144,082, filed on Dec. 30, 2013, now Pat. No. 9,117,424.

(51) Int. Cl.
*G10D 1/02* (2006.01)
*G10G 5/00* (2006.01)

(52) U.S. Cl.
CPC ..... *G10G 5/005* (2013.01)

(58) Field of Classification Search
CPC ..... G10G 5/005
USPC ..... 84/280, 290
See application file for complete search history.

(56) References Cited

U.S. PATENT DOCUMENTS 5,883,315 A * 3/1999 Kaplan et al. ..... 84/279
2014/0216229 A1* 8/2014 Magnusson ..... 84/278

* cited by examiner

*Primary Examiner* — Jianchun Qin
(74) *Attorney, Agent, or Firm* — Plager Schack LLP

(57) ABSTRACT

A musical instrument accessory is configured to provide cushioning to a chest of a musician and to repel moisture from a musical instrument. The musical instrument accessory has a comfort layer configured to repel moisture. A transition layer is mechanically coupled to the comfort layer and provides cushioning. An attachment layer is mechanically coupled to the transition layer and configured to adhere to the musical instrument. The comfort layer, the transition layer and the attachment layer have a common profile shape that is configured to accommodate musical instruments of different sizes.

8 Claims, 5 Drawing Sheets

MUSICAL INSTRUMENT ACCESSORY

RELATED APPLICATION

This application is a continuation-in-part of non-provisional patent application U.S. Ser. No. 14/144,082 filed on Dec. 30, 2013 which, in turn, claims priority to provisional patent application U.S. Ser. No. 61/720,061 filed on Oct. 30, 2012, the entire contents of all of these applications are herein incorporated by reference.

BACKGROUND

The embodiments herein relate generally to accessories for musical instruments or for other cushioning uses.

Prior to embodiments of the disclosed invention, there was no good solution to padding a musical instrument such as violincello (herein "cello") or a bass to a user's chest. Prior art pads and aprons tended to fall off. They did not form a moisture, such as perspiration, barrier, and they did not help the musician's ability to perform. Embodiments of the present invention solve these problems.

SUMMARY

A musical instrument accessory is configured to provide cushioning to a chest of a musician and to repel moisture from a musical instrument. The musical instrument accessory has a comfort layer configured to repel moisture. A transition layer is mechanically coupled to the comfort layer and provides cushioning. An attachment layer is mechanically coupled to the transition layer and configured to adhere to the musical instrument. The comfort layer, the transition layer and the attachment layer have a common profile shape that is configured to accommodate musical instruments of different sizes.

In some embodiments, the common profile shape further has a first rounded extension continuously connected to a first rounded portion. The first rounded portion is shaped similar to an upper belly on the musical instrument and the first rounded extension is shaped similar to a button on the musical instrument. A bottom rounded portion is continuously connected to the first rounded portion. A second rounded extension is continuously connected to the bottom rounded portion. A second rounded portion is continuously connected to the second rounded extension. A collapsing node is continuously connected to the second rounded portion. A third rounded portion is continuously connected to the collapsing node. The third rounded portion is continuously connected to the first rounded extension.

In some embodiments, the transition layer has a consistent thickness. In some embodiments, the transition layer has an inconsistent thickness sloping at an angle. In some cases, the angle is less than twenty degrees. In some cases, the angle is less than five degrees.

In some embodiments, the common profile shape further comprises a first rounded extension continuously connected to a first right rounded portion. The first right rounded portion is shaped similar to an upper belly on the musical instrument and the first rounded extension is shaped similar to a button on the musical instrument. A bottom right rounded portion is continuously connected to the first right rounded portion. A second right rounded extension is continuously connected to the bottom right rounded portion. A second right rounded portion is continuously connected to the second right rounded extension. A right collapsing node is continuously connected to the second right rounded portion. A third rounded portion is continuously connected to the right collapsing node. A left collapsing node is continuously connected to the third rounded portion. A second left rounded portion is continuously connected the left collapsing node. A second left rounded extension is continuously connected to the second left rounded portion. A bottom left rounded portion is continuously connected to the second left rounded extension. A first left rounded portion is continuously connected to the bottom left rounded portion. The first left rounded portion is continuously connected to the first rounded extension.

In some embodiments, the transition layer contracts toward a middle from either side. In other embodiments, the transition layer expands toward a middle from either side.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
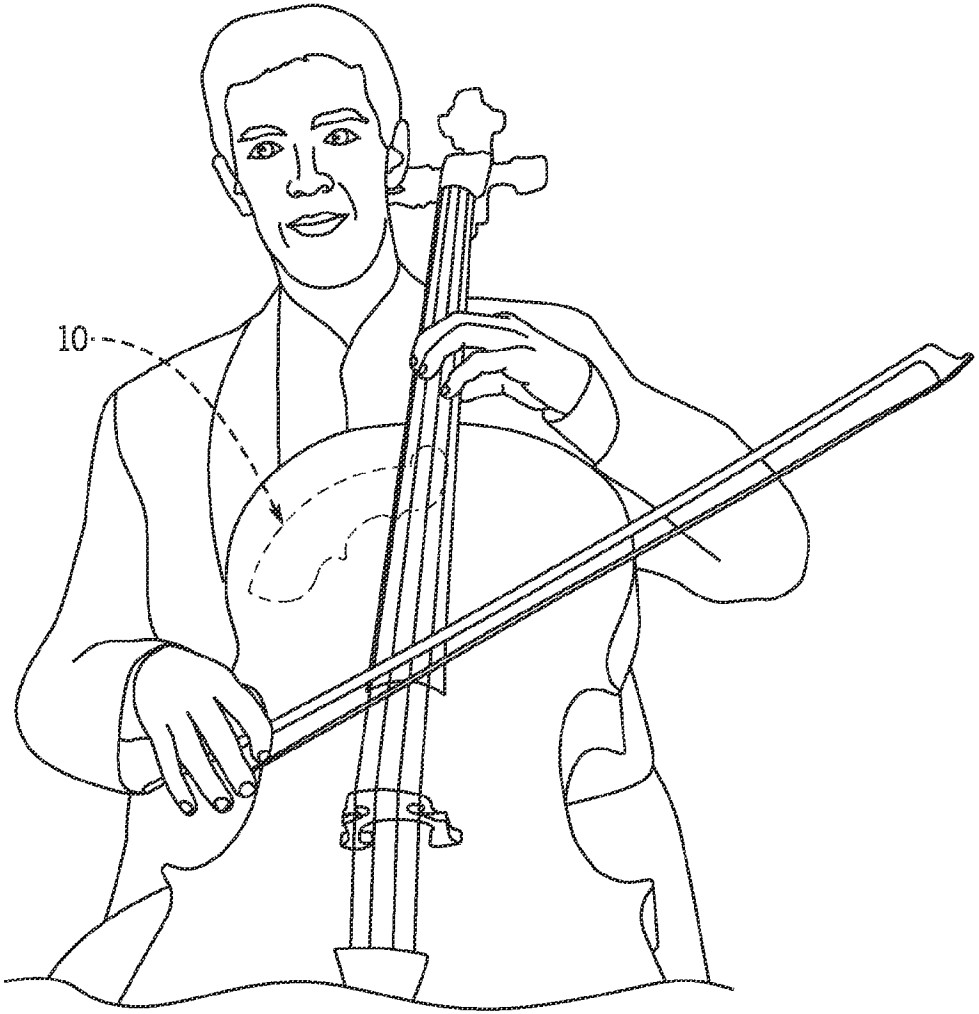
FIG. 1 shows a perspective view of one embodiment of the present invention in use.
Figure 2:
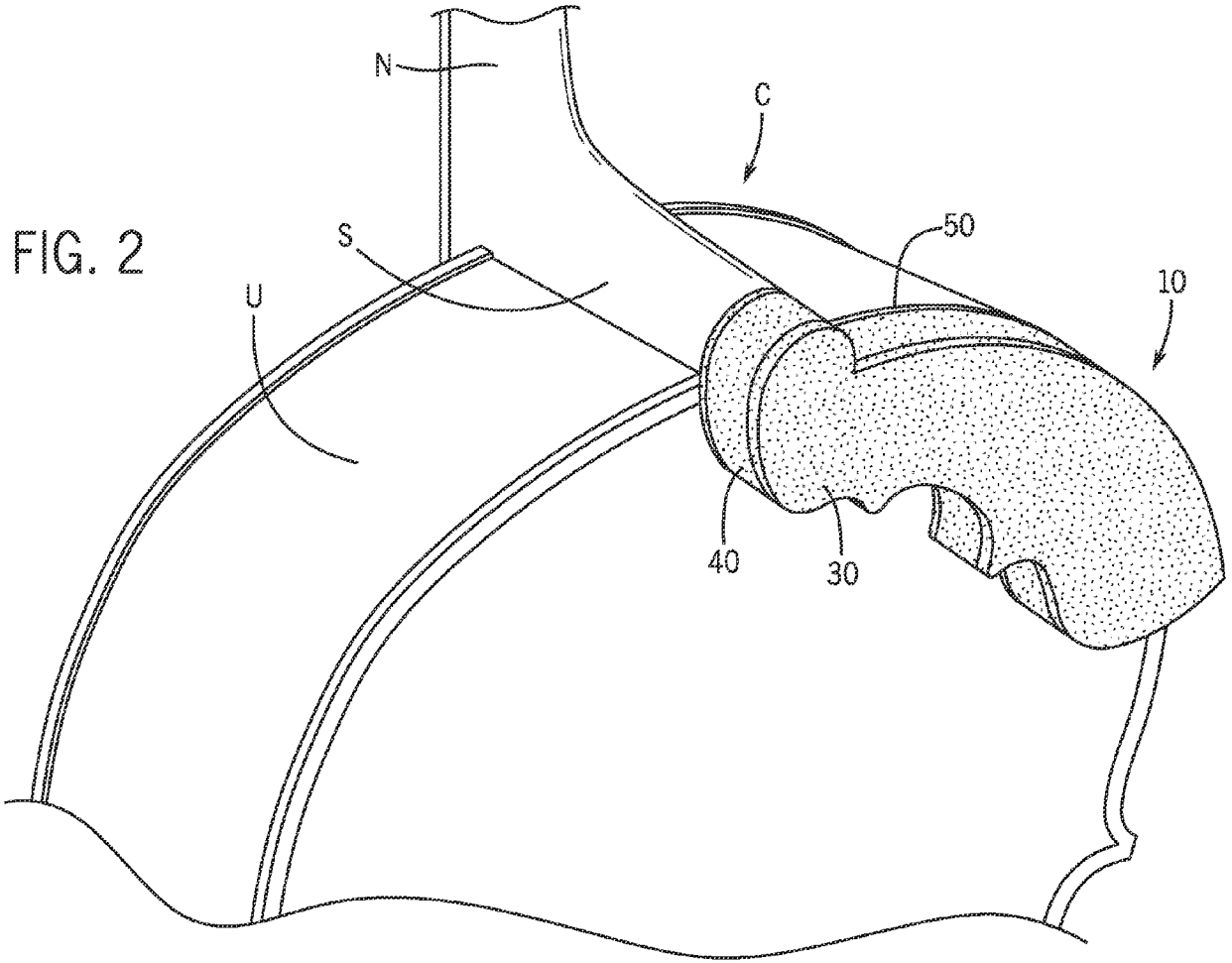
FIG. 2 shows a front perspective view of one embodiment of the present invention.

By way of example, and referring to FIG. 1 and FIG. 2, musical instrument C is a string instrument comprising upper belly U which is mechanically coupled to neck N having shoulder S that terminates at button B. Button B would typically rest against the musician in an uncomfortable further causing perspiration to come in contact with button B and shoulder S having a deleterious effect to the wood of musical instrument C. One example of the present invention is musical instrument accessory 10.

As shown in FIG. 2, musical instrument accessory 10 comprises comfort layer 30 mechanically coupled to transition layer 40. Transition layer 40 is further mechanically coupled to attachment layer 50. Attachment layer 50 is configured to be affixed to musical instrument C without the use of a clamp, strap or any other adhering device. This specialized gripping surface allows musical instrument accessory 10 to be repeatedly attached and detached from musical instrument C without damaging a surface on musical instrument C. While many materials could possibly meet these requirements, adhesive foam is preferred. The adhesive foam uses tiny micro suction cups immediately adjacent to musical instrument C to be readily attached to and detached from musical instrument C. Comfort layer 30 is configured to repel perspiration of the musician from musical instrument C. In some embodiments, comfort layer 30 is removed and transition layer 40 has moisture repelling and comfort properties.

Figure 3:
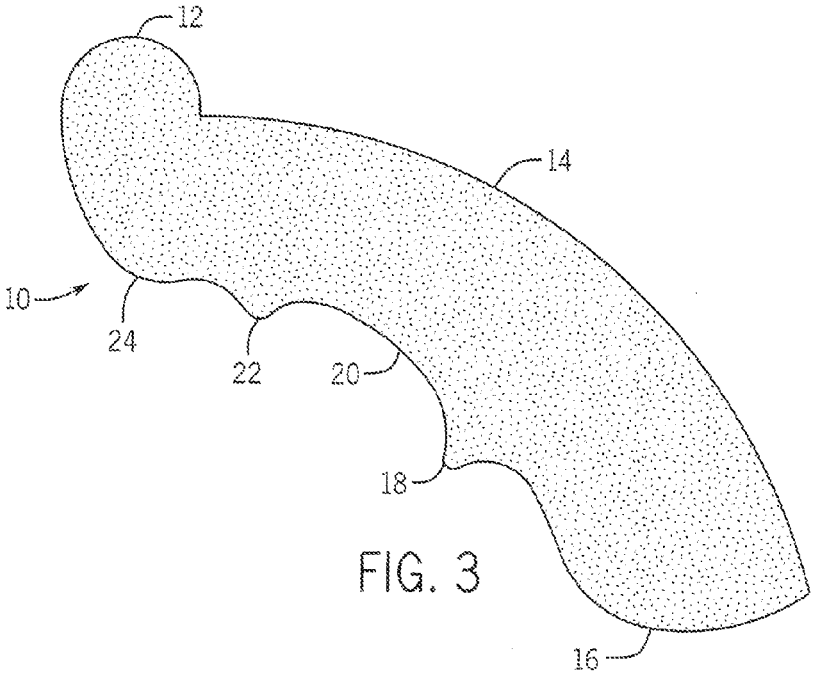
FIG. 3 shows a top plan view of one embodiment of the present invention.

Turning to FIG. 3, each layer in musical instrument accessory 10 is configured with a common profile shape. First rounded extension 12 is continuously connected to first rounded portion 14. First rounded portion 14 is continuously connected to bottom rounded portion 16. Bottom rounded portion 16 is continuously connected to second rounded extension 18. Second rounded extension 18 is continuously connected to second rounded portion 20. Second rounded portion 20 is continuously connected to collapsing node 22. Collapsing node 22 is continuously connected to third rounded portion 24. Third rounded portion 24 is continuously connected to first rounded extension 12.

Figure 7:
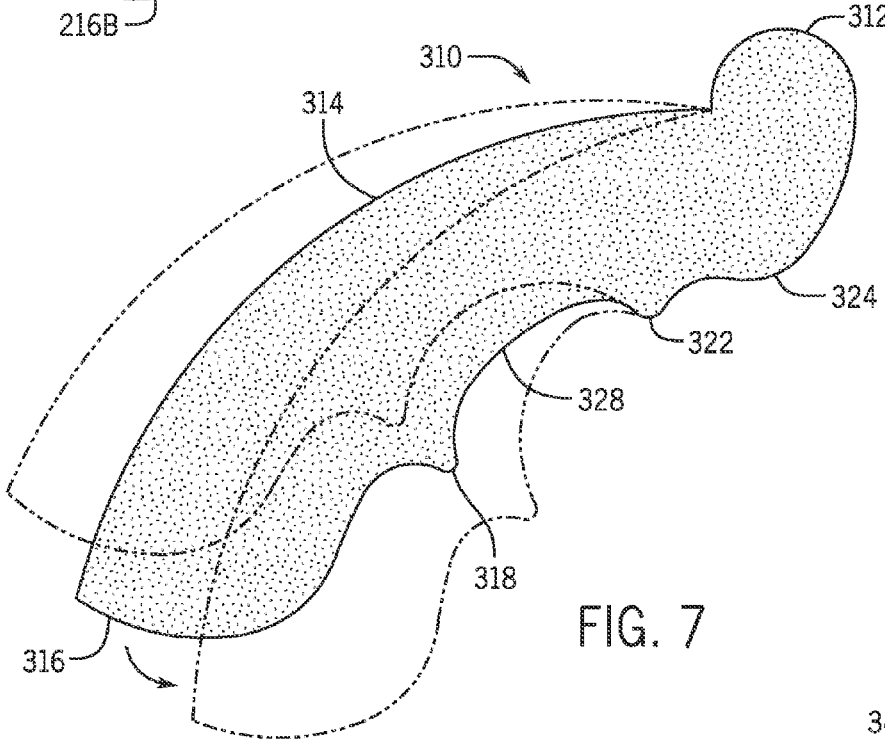
FIG. 7 shows a top plan view of one embodiment of the present invention.

In some embodiments, first rounded extension 12 mirrors the shape of button B, in order to perform an alignment function. Likewise, first rounded portion 14 mirrors the shape of upper belly U. However, for smaller size instruments, this may not be the case. A user may have to collapse bottom rounded portion 16 about collapsing node 22 to get musical instrument accessory 10 to fit on musical instrument C as shown in FIG. 7.

Figure 4:
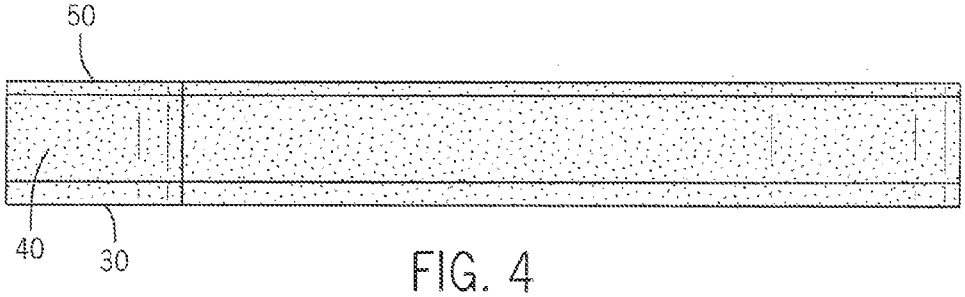
FIG. 4 shows a front elevation view of one embodiment of the present invention.
Figure 5:
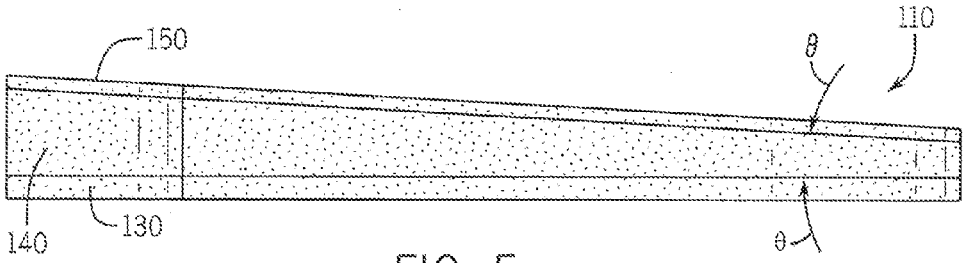
FIG. 5 shows a front elevation view of one embodiment of the present invention.

Turning to FIG. 4 and FIG. 5, comfort layer 30 or comfort layer 130 is typically of a uniform thickness as is attachment layer 50 or attachment layer 150. The difference is in whether transition layer 40, which has a consistent thickness is selected or transition layer 140, which has an inconsistent thickness. As a practical matter, there is some amount of personal preference, however, if too little material is used, then musical instrument accessory 110 can prematurely fail structurally, as a result, theta should be less than twenty degrees and, more preferably, less than five degrees. This is where theta represents the angle at which transition layer 140 shrinks.

Figure 8:
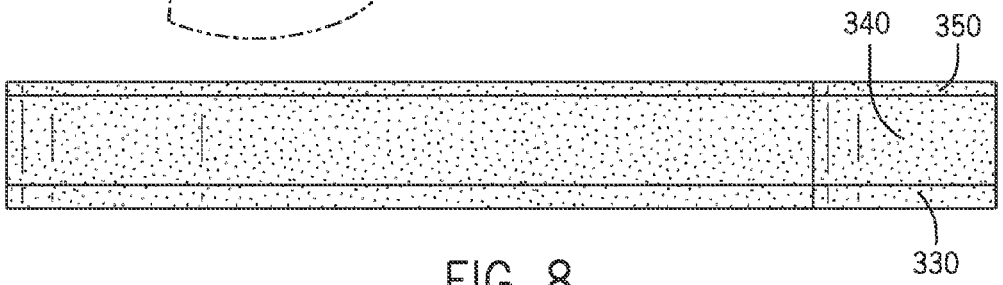
FIG. 8 shows a front elevation view of one embodiment of the present invention.
Figure 9:
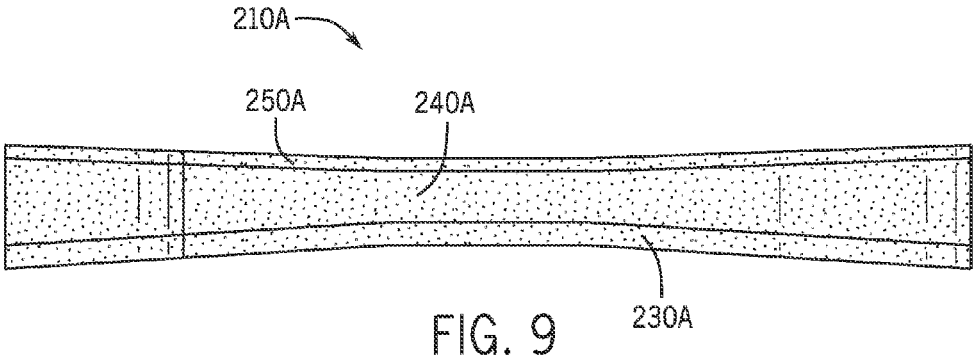
FIG. 9 shows a front elevation view of one embodiment of the present invention.
Figure 10:
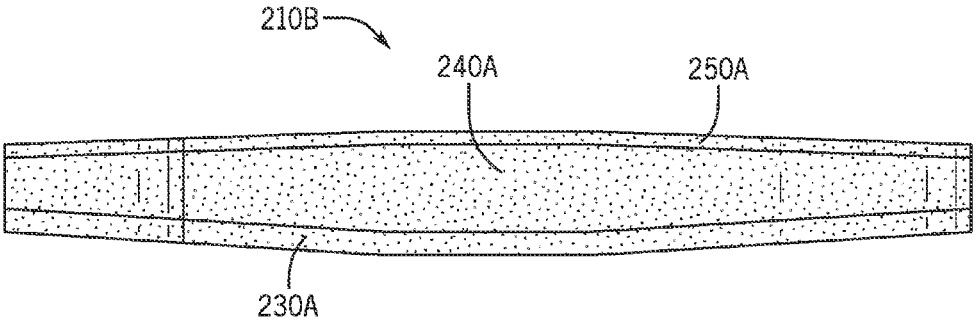
FIG. 10 shows a front elevation view of one embodiment of the present invention.

Generally, a user will prefer to use musical instrument accessory 10 angled away from one's bow hand (as shown in FIG. 1). This can be a rightward orientation (as shown above) or a leftward orientation (as shown in FIG. 7 and FIG. 8. However, some musicians would prefer that musical instrument accessory 210 travel both directions as shown in FIG. 6, FIG. 9 and FIG. 10.

Figure 6:
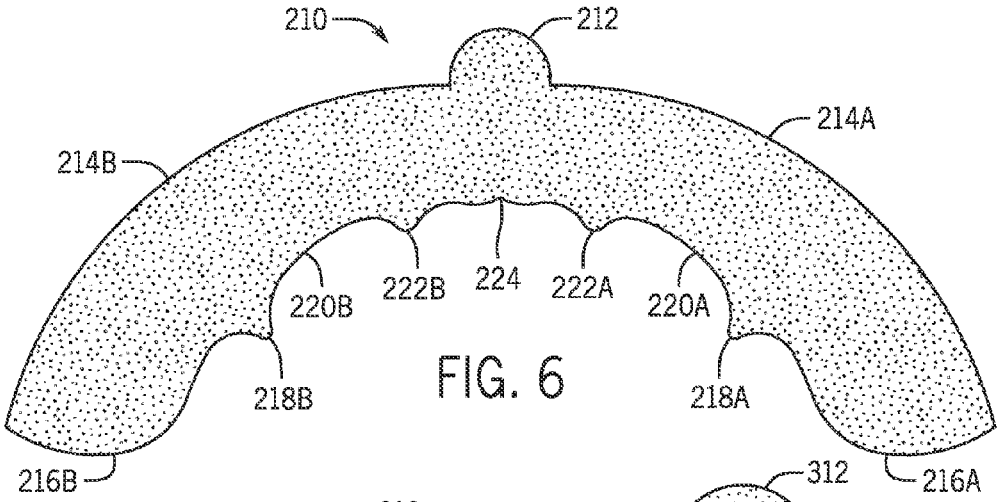
FIG. 6 shows a top plan view of one embodiment of the present invention.

FIG. 6 shows musical instrument accessory 210. Musical instrument accessory 210 includes first rounded extension 212 that is continuously connected to first right rounded portion 214A. First right rounded portion 214A is continuously connected to bottom right rounded portion 216A. Bottom right rounded portion 216A is continuously connected to second right rounded extension 218A. Second right rounded extension 218A is continuously connected to second right rounded portion 220A. Second right rounded portion 220A is continuously connected to right collapsing node 222A. Right collapsing node 222A is continuously connected to third rounded portion 224.

Likewise, first rounded extension 212 is continuously connected to first left rounded portion 214B. First left rounded portion 214B is continuously connected to bottom left rounded portion 216B. Bottom left rounded portion 216B is continuously connected to second left rounded extension 218B. Second left rounded extension 218B is continuously connected to second left rounded portion 220B. Second left rounded portion 220B is continuously connected to left collapsing node 222B. Left collapsing node 222B is continuously connected to third rounded portion 224.

FIG. 7 and FIG. 8 show musical instrument accessory 310, which is configured as follows. First rounded extension 312 is continuously connected to first rounded portion 314. First rounded portion 314 is continuously connected to bottom rounded portion 316. Bottom rounded portion 316 is continuously connected to second rounded extension 318. Second rounded extension 318 is continuously connected to second rounded portion 320. Second rounded portion 320 is continuously connected to collapsing node 322. Collapsing node 322 is continuously connected to third rounded portion 324. Third rounded portion 324 is continuously connected to first rounded extension 312. In FIG. 8, comfort layer 330 is typically of a uniform thickness as is attachment layer 350. In some embodiments, transition layer 340 can have a consistent thickness (as shown) or an inconsistent thickness as described above.

Note that most of musical instrument accessory 310 can collapse about collapsing node 322. Additionally, musical instrument accessory 310 can rotate outward to accommodate a larger musical instrument, such as cellos made prior to the nineteenth century. While musical instrument accessory 310 is configured to be used by a musician who holds a bow in one's left hand, the same property is present in musical instrument accessory 10 for a musician who holds a bow in one's right hand.

FIG. 9 and FIG. 10 show adaptations of musical instrument accessory 210 that may be popular with some musicians. Musical instrument accessory 210A comprises comfort layer 230A mechanically coupled to transition layer 240A. Transition layer 240A is further mechanically coupled to attachment layer 250A. Some user may desire that transition layer 240A contract toward the middle (for example younger musicians, who may want padding closer to one's shoulders). Here theta should be less than twenty degrees and, more preferably, less than five degrees. This is where theta represents the angle at which transition layer 240A shrinks toward the middle from either side. As indicated above, comfort layer 230A may be left out in some embodiments. Comfort layer 230A provides added comfort and moisture protection. Additional moisture protection and comfort layers can be added as desired by the musician.

Musical instrument accessory 210B comprises comfort layer 230B mechanically coupled to transition layer 240B. Transition layer 240B is further mechanically coupled to attachment layer 250B. Some user may desire that transition layer 240B expand toward the middle. Here theta should be less than twenty degrees and, more preferably, less than five degrees. This is where theta represents the angle at which transition layer 240B expands toward the middle from either side. As indicated above, comfort layer 230B may be left out in some embodiments. Comfort layer 230B provides added comfort and moisture protection. Additional moisture protection and comfort layers can be added as desired by the musician.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A musical instrument accessory configured to provide cushioning to a chest of a musician and to repel moisture from a musical instrument; the musical instrument accessory comprising:

a transition layer configured to provide comfort and to repel moisture;

an attachment layer mechanically coupled to the transition layer and configured to adhere to the musical instrument;

wherein the transition layer and the attachment layer have a common profile shape that is configured to accommodate musical instruments of different sizes;

a first rounded extension continuously connected to a first right rounded portion; wherein the first right rounded portion is shaped similar to an upper belly on the musical instrument and the first rounded extension is shaped similar to a button on the musical instrument;

a bottom right rounded portion continuously connected to the first right rounded portion;

a second right rounded extension continuously connected to the bottom right rounded portion;

a second right rounded portion continuously connected to the second right rounded extension;

a right collapsing node continuously connected to the second right rounded portion;

a third rounded portion continuously connected to the right collapsing node;

a left collapsing node continuously connected to the third rounded portion;

a second left rounded portion continuously connected the left collapsing node;

a second left rounded extension continuously connected to the second left rounded portion;

a bottom left rounded portion continuously connected to the second left rounded extension; and a first left rounded portion continuously connected to the bottom left rounded portion; wherein the first left rounded portion is continuously connected to the first rounded extension.

2. The musical instrument accessory of claim 1, wherein the transition layer contracts toward a middle from either side.

3. The musical instrument accessory of claim 1, wherein the transition layer expands toward a middle from either side.

4. A musical instrument accessory configured to provide cushioning to a chest of a musician and to repel moisture from a musical instrument; the musical instrument accessory comprising:

a transition layer configured to provide comfort and to repel moisture;

an attachment layer mechanically coupled to the transition layer and configured to adhere to the musical instrument;

wherein the transition layer and the attachment layer have a common profile shape that is configured to accommodate musical instruments of different sizes;

a first rounded extension continuously connected to a first rounded portion; wherein the first rounded portion is shaped similar to an upper belly on the musical instrument and the first rounded extension is shaped similar to a button on the musical instrument;

a bottom rounded portion continuously connected to the first rounded portion;

a second rounded extension continuously connected to the bottom rounded portion;

a second rounded portion continuously connected to the second rounded extension;

a collapsing node continuously connected to the second rounded portion; and a third rounded portion continuously connected to the collapsing node; wherein the third rounded portion is continuously connected to the first rounded extension.

5. The musical instrument accessory of claim 4, further comprising a comfort layer attached to the transition layer and configured to provide additional comfort and additional moisture protection.

6. The musical instrument accessory of claim 4, wherein the transition layer has a consistent thickness.

7. The musical instrument accessory of claim 4, wherein the transition layer has an inconsistent thickness sloping at an angle.

8. The musical instrument accessory of claim 4, wherein the angle is less than twenty degrees.

* * * * *